United States Patent [19]

Landi et al.

[11] Patent Number: 4,485,568

[45] Date of Patent: Dec. 4, 1984

[54] INSOLE

[76] Inventors: Curtis L. Landi; Susan L. Wilson, both of 10215 Parkwood Dr., Cupertino, Calif. 95014

[21] Appl. No.: 478,672

[22] Filed: Mar. 25, 1983

[51] Int. Cl.[3] ..... A43B 13/38; A43B 13/18; A43B 13/14

[52] U.S. Cl. ..... 36/44; 36/28; 36/103

[58] Field of Search ..... 36/44, 103, 28, 29, 36/43; 428/72, 73, 116, 118

[56] References Cited

U.S. PATENT DOCUMENTS

| | | | |
|---|---|---|---|
| 1,659,339 | 2/1928 | Vetterling | 36/28 |
| 1,994,681 | 3/1935 | Blumenfeld | 36/28 |
| 2,546,296 | 3/1951 | Braun | 36/28 |
| 3,018,205 | 1/1962 | Barut | 428/116 |
| 3,483,070 | 12/1969 | Kennedy et al. | 428/118 |
| 3,556,917 | 1/1971 | Eakin et al. | 428/118 |
| 4,382,106 | 5/1983 | Royster | 428/116 |

FOREIGN PATENT DOCUMENTS

| | | | |
|---|---|---|---|
| 1373063 | 11/1974 | United Kingdom | 428/116 |

*Primary Examiner*—Werner H. Schroeder
*Assistant Examiner*—Steven N. Meyers
*Attorney, Agent, or Firm*—Manfred M. Warren; Robert B. Chickering; Glen R. Grunewald

[57] ABSTRACT

An sole having an upper elastomer foam pad supported by an overexpanded honeycomb structure, the overexpanded honeycomb structure made by intermittently bonding ribbons of elastomer and expanding them laterally to produce a honeycomb structure having rectangular cells with the longer opposite walls of the rectangle twice the length of the shorter opposite walls of the rectangle, with the shorter opposite walls of the rectangle being double walls, and with the shorter opposite walls of the rectangle elongated in the direction across the sole.

6 Claims, 5 Drawing Figures

INSOLE

BACKGROUND OF THE INVENTION

Honeycomb material is a familiar product. It consists of an array of hexagonal cells made of flat sheet material and nesting so that each of the six walls of one hexagon is shared with a wall of an adjacent hexagon. When a honeycomb is made of stiff material it is very strong in the direction perpendicular with the axes of the hexagonal cells. It is frequently bonded between flat sheets to make strong but lightweight panels to make walls, airplanes, boats and other structures where rigidity, strength and light weight are important. Honeycomb material is also made of resilient material and in such form it has been used as a cushion. For example, U.S. Pat. No. 532,429 issued to Rogers discloses such a honeycomb structure as an insole.

The use of a honeycomb structure as a cushion is desirable because buckling of the thin walls of the honeycomb absorbs a great deal of energy per unit of thickness of the cushion. However, the honeycomb structure is inherently stiff and using a honeycomb cushion within a shoe causes the shoe to be inflexible.

One way known to manufacture a honeycomb structure is to place a number of ribbons side by side and bond them together intermittently. Thus, if two strips are bonded along their length along a given distance and then unbonded three times that distance, and if the other side of each strip is similarly bonded but with the bonding appropriately offset, expanding the elongated strips thus bonded in a lateral direction creates a honeycomb structure. This method of manufacturing a honeycomb structure will be discussed in greater detail hereinafter.

The difference between a honeycomb structure made by partial bonding of adjacent strips and conventional honeycomb structures is that one-third of the parallel walls of each hexagon are double, that is, are formed from the portions of two adjacent ribbons that were bonded together.

As stated above, the honeycomb structure made from intermittently bonded strips is created by laterally expanding the adjacent strips. However, the strips may also be overexpanded so that the two sides of the hexagon forming the top and bottom point straighten to lie in the same plane, in which case the hexagons become deformed into rectangles where two opposite sides are twice as long as the other two opposite sides. Overexpanded strips are very flexible in one direction and quite stiff in the other. The short sides of the rectangles are difficult to buckle and they are short and of double thickness, both of which contribute to stiffness. The long sides of the rectangle of an overexpanded honeycomb are twice as long as two short sides and therefore buckle more easily and in addition they are single thickness which also causes them to buckle more easily.

SUMMARY OF THE INVENTION

This invention is a sole for a shoe that is lightweight, that absorbs energy, i.e., the force of a foot making impact with a surface, that is very flexible along the length of the foot so that it bends easily while walking or running and stiff from side to side of the foot to prevent lateral motion of the foot during walking or running and to absorb the energy of impact. The sole of this invention includes a pad made of any suitable material such as foam elastomer. The pad is supported by an overexpanded honeycomb structure that supports the pad with the parallel double walls running across the width of the sole and the parallel single walls running the length of the sole. In a preferred embodiment, the overexpanded honeycomb structure is fixed to the pad to retain its overexpanded position and another pad, or at least a flexible sheet is bonded to the opposite side of the honeycomb cells so that the honeycomb structure is contained between a top and a bottom sheet of material.

The honeycomb structure is made of resilient material such as rubber. In the context of this description, resilient material is material that is flexible and that restores itself to its original shape when deformed, as opposed to flexible material which may not be resilient. For example, paper is flexible while rubber is resilient The sole of this invention may be employed as a separate insole to be inserted in shoes before they are worn, it may be employed as an insole permanently made in a shoe, it may be employed as a midsole and it may even be used as an outsole. The sole of this invention is not limited to any type of shoe but has greatest utility in athletic shoes such as running shoes, court shoes, and cleated shoes used in various sports. The side-to-side stiffness of the sole of this invention is particularly adapted to resist, or even to correct lateral movement or thrusts of a foot within a shoe during running or when making rapid changes in direction as in a court game. In fact, having a sole where the thickness of the honeycomb structure varies across the width of the sole can provide additional support for specific foot weaknesses such as where a runner's ankle tends to buckle inwardly each time his or her heel strikes the ground. Such a condition may be corrected or at least mitigated by having deeper honeycomb structure on the inside of the sole whereby it will resist lateral thrusts of .PA the foot while still being extremely flexible in bending between the heel and the toe.

At least one pad of each sole must be of foamed elastomer or its equivalent. The pads both cushion the foot from the sharp edges of the honeycomb cells and contain the honeycomb in overexpanded position. The pads may be continuous or they may be perforate to provide ventilation beneath a user's foot.

The honeycomb structure is oriented so that the walls of each expanded honeycomb cell lie in a plane perpendicular to the plane of the pad.

DETAILED DESCRIPTION OF THE INVENTION

Figure 1:
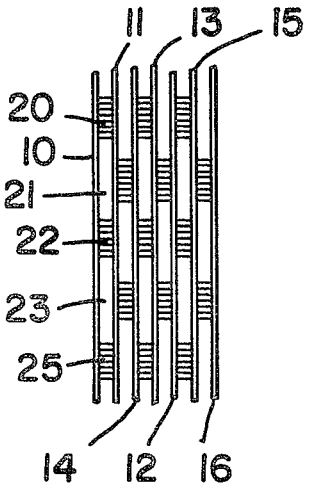
FIG. 1 is a plan view of parallel ribbons bonded in order to make a product useful in the present invention.

An essential element of the present invention is an overexpanded honeycomb having parallel double walls extending in one direction. One manner of making such a honeycomb is to bond ribbons that are aligned in a parallel array with the bonding constituting one quarter of the areas of the ribbons. In FIG. 1 such a parallel array is illustrated. Ribbons 10, 11, 12, 13, 14, 15 and 16 are aligned not only to be parallel with one another but to have the plannar surfaces of the ribbons parallel to one another. Bonding is effected between ribbon 10 and ribbon 11 at positions 20, 22 and 25. The unbonded areas 21 and 23 are three times the length of the bonded areas 20, 22 and 25.

Ribbon 12 is then aligned parallel with ribbon 11 and bonded to it in the same manner except that the bonded areas bisect the unbonded areas between ribbon 10 and ribbon 11. Ribbon 13 is bonded to ribbon 12 in the same manner except the bonded areas between ribbon 12 and 13 coincide in position with the bonded areas 20, 22 and 25 between ribbon 10 and ribbon 11. The pattern is repeated for as many side-to-side ribbons as is required to make a honeycomb structure of the desired size. Bonding is usually effected with adhesive. In all figures, the bonded area is represented by short, horizontal lines between the ribbons to be bonded.

Figure 2:
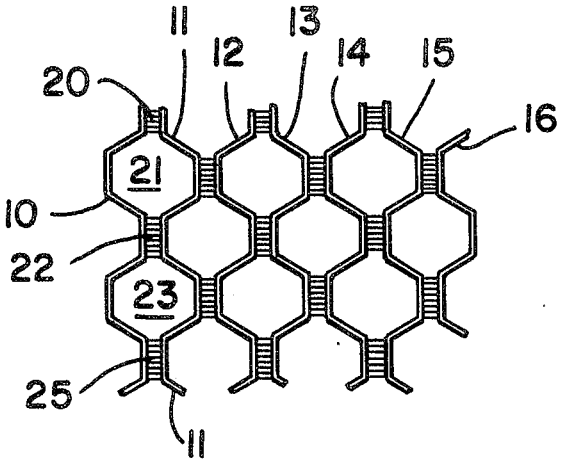
FIG. 2 is a plan view of the structure of FIG. 1 expanded laterally to form a honeycomb.

The structure illustrated in FIG. 1 may be expanded by holding ribbon 10 and moving ribbon 16 sideways and to the right, as illustrated in FIG. 1. Upon expanding the structure of FIG. 1 in such a manner, a structure such as illustrated in FIG. 2, is formed. This familiar, hexagonal, honeycomb structure is very rigid considering the amount of material employed and the ribbon-like nature of the material. When made of stiff plastic, impregnated paper, or narrow strips of metal, the structure is strong enough to form a very rigid panel. Even when made of resilient materials such as ribbons of rubber, the structure illustrated in FIG. 2 is much stiffer in all directions than the material from which it is made.

Figure 3:
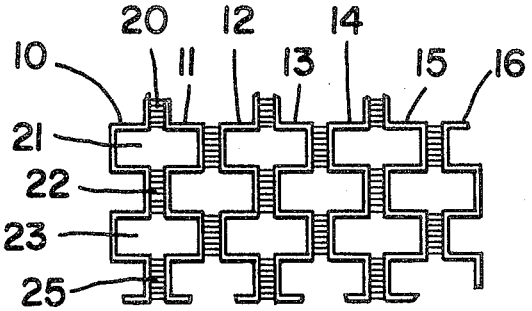
FIG. 3 is a plan view of the structure of FIG. 1 that has been laterally overexpanded.

FIG. 3 illustrates the overexpanded honeycomb structure which is obtained by moving ribbon 16 as illustrated in FIG. 2 even farther to the right. The overexpanded structure in FIG. 3 is the maximum expanison that can be obtained without stretching any of the resilient ribbons. The hexagonal cells illustrated in FIG. 2 are expanded to rectangular cells in which two opposite walls are twice the length of the other two opposite walls. The overexpanded structure as illustrated in FIG. 3 has double walls for all of the vertically extending walls while all of the horizontally-extending walls are single walls. In addition, the double walls are short while the single walls are long. The double walls are accordingly much more rigid both because of their double structure and because of their ability to resist buckling because of their short length while the horizontal walls are very flexible because they are single walls and because their expanded length makes buckling relatively easy.

Figure 4:
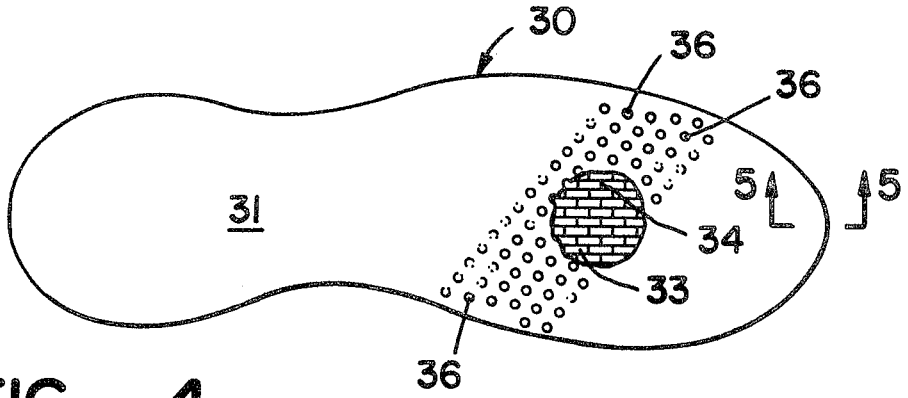
FIG. 4 illustrates an insole embodying this invention partly cut away.
Figure 5:
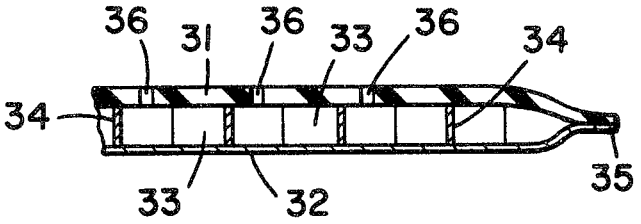
FIG. 5 is a cross section of the insole illustrated in FIG. 4 taken along the line 5—5 of FIG. 4.

FIG. 4 illustrates an insole embodying this invention. The insole is generally designated 30 and it consists of an upper foam elastomer pad 31, a lower sheet 32 (illustrated in FIG. 5) that may be foam elastomer or may simply be sheet material. The pad 31 and sheet 32 are bonded together around the edges as at 35 illustrated in FIG. 5. The cutaway portion in FIG. 4 shows that between pads 31 and 32 is the overexpanded honeycomb structure as illustrated in FIG. 3 with double walls 34 running across the width of the insole while single walls 33 run the length of the insole. This is also illustrated in FIG. 5.

The insole constructed as illustrated in FIG. 4 is very flexible from front to back. In other words, one walking on the insole of this invention would meet substantially no resistance in bending the insole from front to back to accommodate to the normal flexing of the foot as one walks or runs. However, the insole is quite rigid from side to side and resists bending or sideways slumping. In addition, the cushioning effect of the insole, specifically its ability to resist vertical forces, is the same in the overexpanded condition shown in FIG. 3 as it is in the expanded position shown in FIG. 2 because the same number of walls of the same length and with the same resistance to crushing are involved whether the honeycomb structure is expanded or overexpanded.

It is preferred that the cushion 31 be perforated with small holes 36 in an array such that each cell in the overexpanded honeycomb is ventilated. The perforated pad provides air circulation through the insole and prevents the insole from cushioning by compressing air in individual sealed cells. The array of perforations illustrated in FIG. 4 is only partial to avoid obscuring other structural features by unnecessarily completing the repeating pattern of holes.

Although the sole of this invention has been described with reference to a separate insole, it is evident that a shoe, particularly an athletic shoe, may be constructed with a permanent insole, midsole or outersole of this structure. It is also evident that the depth of the honeycomb structure, i.e., how far the honeycomb structure would hold foam pad 31 from sheet 32, can be varied depending upon the amount of cushioning desired and can be varied from one position in a sole to another. Specifically, a sole can be constructed with deeper honeycomb in the heel portion than in the portion supporting the ball of the foot to cushion heel impact shocks to a greater extent than the less forceful shocks absorbed by the ball of the foot.

What is claimed is:

1. A sole comprising a pad, an element supporting said paid comprising a honeycomb made of resilient material and having one set of double walls, said honeycomb being overexpanded in a direction perpendicular to the double walls and being fixed beneath said pad with the length of the double walls extending across the short direction of the sole.

2. The sole of claim 1 wherein said pad is foam elastomer.

3. The sole of claim 1 wherein said overexpanded honeycomb is contained between a pad and sheet material.

4. The sole of claim 1 wherein said overexpanded honeycomb is comprised of ribbons of elastomer.

5. The sole of claim 1 fixed permanently in a shoe.

6. The insole of claim 1 wherein said pad is perforated and said perforations are closer together than the major dimension of a cell of said overexpanded honeycomb.

* * * * *